United States Patent [19]

Spavin

[11] Patent Number: 4,743,139

[45] Date of Patent: May 10, 1988

[54] EXPANSION JOINT

[75] Inventor: Graham G. Spavin, Scarborough, Canada

[73] Assignee: Stelenco Limited, Thornhill, Canada

[21] Appl. No.: 6,192

[22] Filed: Jan. 23, 1987

[51] Int. Cl.[4] ..... E01C 11/02

[52] U.S. Cl. ..... 404/65; 404/69

[58] Field of Search ..... 404/64–69

[56] References Cited

U.S. PATENT DOCUMENTS

| | | | |
|---|---|---|---|
| 2,577,998 | 12/1951 | Carter | 404/66 |
| 3,850,539 | 11/1974 | Bowman et al. | 404/69 |
| 4,041,665 | 8/1977 | deMunck | 404/65 X |
| 4,366,590 | 1/1983 | Huber et al. | 404/68 X |
| 4,537,003 | 8/1985 | Huber et al. | 404/65 X |

*Primary Examiner*—George A. Suchfield

*Assistant Examiner*—Matthew Smith

*Attorney, Agent, or Firm*—Rogers, Bereskin & Parr

[57] ABSTRACT

An expansion joint for use between adjacent sections of a roadway comprises a resilient seal for extending along the gap between the sections and two seal retainers adapted to be secured to the respective roadway sections on opposite sides of the gap. Each retainer has a cavity that opens towards the other retainer and internal shoulders on opposite sides of the opening. The seal has a V-shaped centre web and enlarged ears along opposite margins that fit into the retainer cavities. Each ear has two shoulders that abut against the shoulders in the cavity and prevent the ear being withdrawn from the cavity. The respective shoulders are carried by parts of the seal that have convex abutting faces, biassing the shoulders on the ear against the shoulders of the cavity.

6 Claims, 2 Drawing Sheets

EXPANSION JOINT

FIELD OF THE INVENTION

This invention relates generally to expansion joints for use between adjacent sections of a roadway or the like.

BACKGROUND OF THE INVENTION

A bridge or elevated roadway for example may be constructed of a series of separate structural slabs placed end-to-end. It is necessary to leave gaps between the slabs to accommodate thermal expansion and contraction. Normal practice is to bridge these gaps by means of a joint that can provide an effective seal between the slabs as well as permitting relative movement thereof. Many different forms of expansion joint have been devised with the aim of serving this function. Generally, an expansion joint of this type comprises a pair of channel-shaped steel retainers that are secured to the roadway sections to be joined with their channels facing one another, and an elongate rubber seal member, marginal portions of which are installed in the respective retainers. Typically, the seal is generally V-shaped in cross-section so that movement of the two roadway sections relative to one another will be accommodated by variations in the angle of the V.

Expansion joints are of course subject to severe service conditions. The seal must be capable of withstanding not only year-round weather and temperature changes, but also the effects of road salt, grit and other debris. When a particular joint is in an open condition, stones, rocks and other debris can accumulate in the seal and generally will not be dislodged naturally. When the gap closes due to temperature change, the debris can damage the seal or exert forces that tend to tear the seal out of one of its retainers.

DESCRIPTION OF THE PRIOR ART

The patent literature contains numerous examples of prior proposals for expansion joints. Typical examples are to be found in Canadian Pat. Nos. 1,178,098 issued Nov. 20, 1984 to The D. S. Brown Company, 1,135,104 issued Nov. 9, 1982 to Honel Holding AG, and 1,037,757 issued Sept. 5, 1978 to Acme Highway Products Corporation. This latter patent discloses a proposal for improving retention of the seal within the seal retainer by selecting the curvature of a marginal bead on a seal in relation to a corresponding curvature of the cavity in the seal retainer so that the bead is urged firmly against the top and bottom of the cavity when installed.

An object of the present invention is to provide an expansion joint having improved seal retention means.

SUMMARY OF THE INVENTION

According to the invention there is provided an expansion joint for use between adjacent sections of a roadway or the like, comprising an elongate resilient seal for extending along a gap between said sections, and first and second seal retainers adapted to be secured to the respective said roadway sections on opposite sides of the gap. Each retainer has an elongate cavity which is of uniform cross-sectional shape throughout its length and which has an opening for receiving the seal and respective internal shoulders on opposite sides of the opening. The seal is of substantially uniform shape throughout its length and includes a web permitting expansion and contraction of the seal in the direction of its width and respective marginal portions each including an enlarged ear capable of being installed in and substantially filling said retainer cavity. Each ear has external shoulders for engagement with the internal shoulders of the cavity, the external shoulders being formed on respective parts of the ear that have abutting faces shaped to normally deflect said parts angularly outwardly about respective axes extending generally longitudinally of the seal towards said shoulders, while permitting the ear to be compressed for fitting into the cavity, whereby, in the installed condition, the shoulders on the ear are biassed against the shoulders of the cavity.

It is believed that this particular form of seal having a two-part ear along each margin will result in improved retention of the seal within the retainers because of the biassing effect of the external shoulders on the seal against the internal shoulders in the cavity. The seal itself can be extruded in one piece from tough resilient material such as neoprene or silicone which should provide for a long-lasting and durable seal.

BRIEF DESCRIPTION OF THE DRAWINGS

In order that the invention may be more clearly understood, reference will now be made to the accompanying drawings which illustrate a preferred embodiment of the invention by way of example, and in which.

DESCRIPTION OF THE PREFERRED EMBODIMENTS

Figure 1:
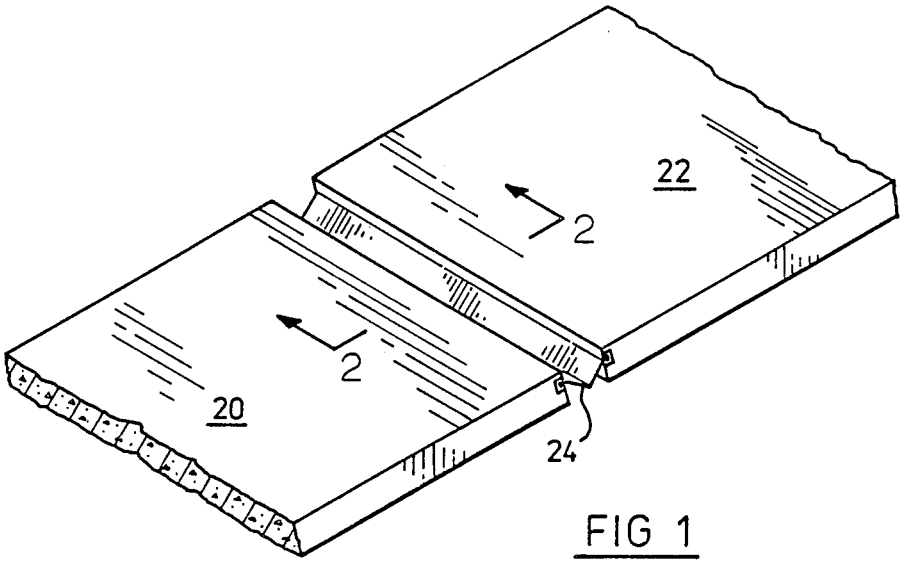
FIG. 1 is a somewhat diagrammatic perspective illustration of two sections of a roadway connected by a joint of the form provided by the invention.
Figure 2:
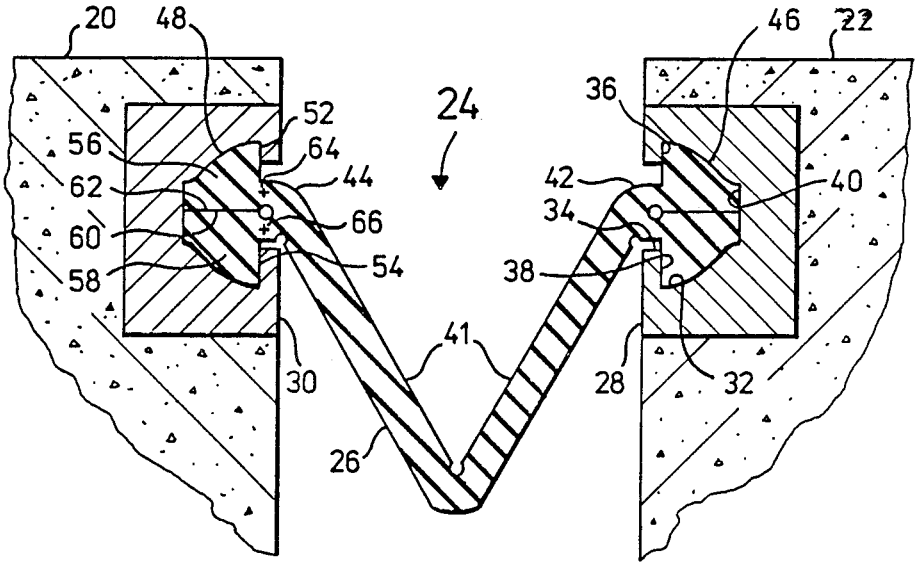
FIG. 2 is a vertical sectional view on line 2—2 of FIG. 1.

Referring first to FIG. 1, two adjacent roadway sections are shown at 20 and 22 with an expansion joint 24 installed therebetween. As best seen in FIG. 2, the expansion joint comprises an elongate resilient seal 26 for extending along the gap between the roadway sections 20 and 22, and two seal retainers 28 and 30 secured to the respective roadway sections on opposite sides of the gap. In this embodiment, the retainers are shown embedded in opposing end faces of two concrete roadway sections although this is not of course essential. The retainers could be secured to the sections in other ways, for example by bolts carried by the retainers and embedded in the concrete. Also, the joint can be installed other than in opposing end faces of concrete slabs; for example, it could be installed in the end face of one slab and in the side of another slab at right angles to the first slab.

In any event, each of the retainers 28 and 30 is made of steel and has an elongate cavity which is of uniform cross-sectional shape throughout the length of the retainer. The two retainers shown in the drawings are essentially identical and therefore reference will be made primarily to retainer 28, it being understood that this retainer is representative of both. The retainer cavity is denoted 32 and has an opening 34 for receiving the seal and respective internal shoulders 36 and 38 on opposite sides of the opening. The cavity also has a back wall 40 which is of somewhat C-shaped configuration in section although the particular shape is not believed to be critical to the invention.

The seal 26 is also of substantially uniform cross-sectional shape throughout its length. In this embodiment, the seal includes a generally V-shaped web 41 that permits expansion and contraction of the seal in the direction of its width by varying the included angle of the V. The seal also has respective marginal portions 42 and 44, each of which includes an enlarged ear 46, 48 respectively, capable of being installed in and substantially filling the cavity in the retainer.

The two ears 46 and 48 are essentially identical; again, reference will be confined to only one of the two ears (in this case ear 48) as representative of both. As noted previously, the ear is shaped so that it can be installed in and substantially fill the retainer cavity. The ear also has external shoulders 52 and 54 for engagement with the internal shoulders of the cavity (denoted 36 and 38 in the case of retainer 28). These external shoulders 52 and 54 are formed on respective parts 56, 58 of the ear that have abutting faces 60 and 62 shaped to normally deflect the parts 56, 58 angularly outwardly about respective axes 64, 66 extending generally longitudinally of the seal, towards the shoulders. At the same time, the parts 56, 58 permit the ear overall to be compressed for fitting into the cavity. Thus, in the installed condition, the shoulders 52, 54 on the ear are biassed against the opposing shoulders of the cavity, thereby firmly holding the seal in the retainer.

It will of course be understood that the two axes 64 and 66 are virtual axes only and that the two parts 56, 58 of the ear will in fact generally bend rather than strictly geometrically pivoting about an axis. However, it is believed that reference to the two axes is useful for clarity of description.

Figure 4:
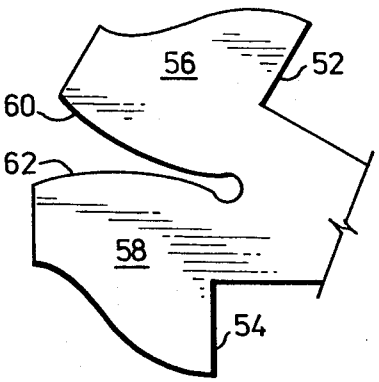
Figure 3:
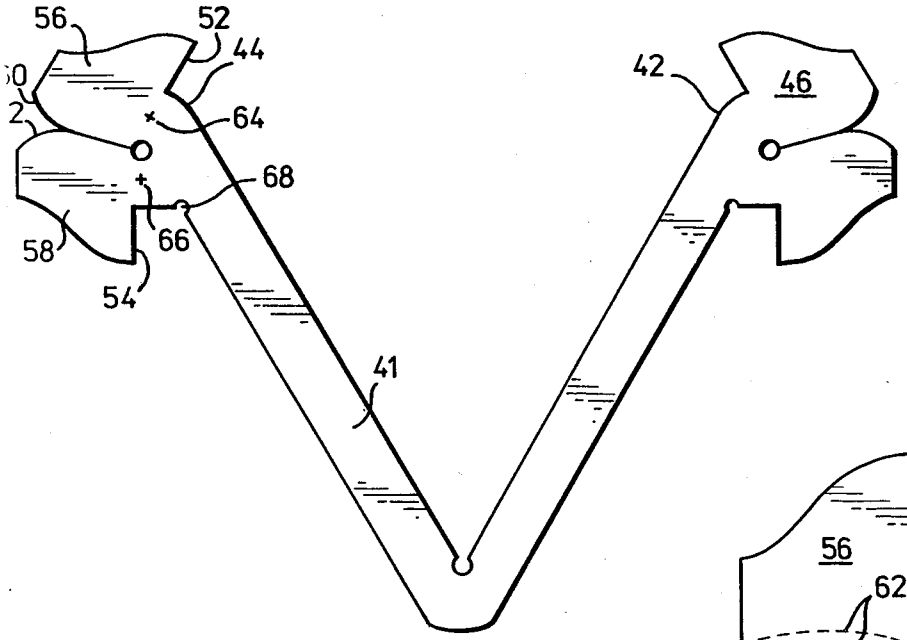
FIG. 3 is a view similar to FIG. 2 showing the seal of the expansion joint prior to installation; and, FIGS. 4 and 5 are detail views of one of the ears of the seal shown respectively in its as-moulded condition and as installed.

FIGS. 3 and 4 show the seal in its unconfined condition and permit the shapes of the abutting faces of the two parts of the ear to be seen. With continued reference to ear 48 it will be seen that the two faces 60 and 62 are convex and hold the two parts 56, 58 in the outwardly deflected positions referred to previously so that the shoulders 52 and 54 are no longer in a common plane but are angled inwardly at less than 180° with respect to one another. This provides the biassing effect referred to previously.

As seen in FIG. 3, the seal is in its normal unconfined configuration in which the two faces 60 and 62 have tended to flatten one another to some extent by virtue of the positions they normally adopt. FIG. 4 on the other hand shows the shape of the two parts of the bead as-moulded. It will be noted that a circular section relief cavity of small diameter is provided at the inner junction of the two faces 60, 62 to prevent tearing of the seal at that location. A further, similar relief formation is indicated at 66 adjacent the lowermost part 58 of the ear.

Figure 5:
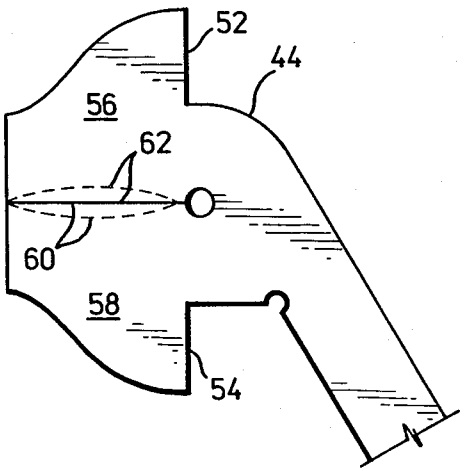

FIG. 5 shows the ear 48 in its installed position. The two surfaces 60 and 62 are shown in full line in the flattened positions they occupy when the seal is installed; the dotted line positions indicate the shapes of those surfaces when the seal is unconfined.

Installation of the seal into the retainers will be accomplished by first inserting the lower part of each ear in turn into the bottom portion of the cavity in the relevant retainer. The upper part of the ear will probably have to be folded back somewhat and will remain outside the retainer cavity at this stage. That part will then be forced into the cavity from above by using an appropriate tool starting at one end of the seal and working progressively along the length of the seal until the ear is fully installed. The operation will then be repeated for the other ear. When each ear is fully installed, the external shoulders on the ear will abut directly against the internal shoulders in the retainer cavity as described previously and prevent the ear being pulled out of the cavity. Thus, it is anticipated that it will be virtually impossible to remove the ear once it has been installed, other than by completely destroying the seal.

As noted previously, the seal retainers are made of steel in this embodiment; the seal itself is extruded in neoprene or silicone. However, other materials may be used.

Other modifications that may be made within the broad scope of the invention include changes in the shape of the two parts of the ear, of the web of the seal and of the retainer cavity. For example, the seal web 42 could be made of inverted V-shape. In some situations, this configuration may be helpful in resisting accumulation of debris within the seal. Also, the abutting faces 60, 62 of the two parts of each seal ear may be shaped differently than shown provided the required biassing apart effect is achieved. For example, one or both of the surfaces could be corrugated or angularly shaped. In the embodiment illustrated, one of the surfaces could be flat and the other convex.

I claim:

1. An expansion joint for use between adjacent sections of a roadway or the like, comprising an elongate, resilient seal for extending along a gap between said sections, and first and second seal retainers adapted to be secured to the respective said roadway sections on opposite sides of said gap, each said retainer having an elongate cavity which is of uniform cross-sectional shape throughout its length and which has an opening for receiving the seal and respective, flat internal shoulders on opposite sides of said opening, said seal being of substantially uniform crosssectional shape throughout its length and including a web permitting expansion and contraction of the seal in the direction of its width, and respective marginal portions each including an enlarged ear capable of being installed in and substantially filling said retainer cavity, each said ear comprising first and second parts which are both flexibly coupled to said web and which have respective abutting faces extending outwardly from the web to outer faces of the ear parts remote from the web, said parts having respective flat external shoulders for engagement with the internal shoulders of the cavity, and said abutting faces being shaped to normally deflect said parts angularly outwardly about respective axes extending generally longitudinally of the seal towards said shoulders, while permitting the ear to be compressed for fitting into said cavity, whereby, in the installed condition, the shoulders on the ear are biassed against the shoulders of the cavity.

2. An expansion joint as claimed in claim 1, wherein at least one of said abutting faces of the respective parts of each ear is of convex shape for providing said deflection of the parts of the ear angularly outwardly with respect to one another.

3. An expansion joint as claimed in claim 1, wherein said web of the seal is generally V-shaped in cross section.

4. An expansion joint as claimed in claim 1, wherein said seal comprises a neoprene extrusion.

5. An expansion joint as claimed in claim 1, wherein said seal comprises a silicone extrusion.

6. For use in an expansion joint as claimed in claim 1, an elongate resilient seal which is of substantially uniform cross-sectional shape throughout its length and which includes a web permitting expansion of the seal in the direction of its width and respective marginal portions each including an enlarged ear capable of being installed in and substantially filling said seal retainer cavity, each said ear comprising first and second parts which are both flexibly coupled to said web and which have respective abutting faces extending outwardly from the web to outer faces of the ear parts remote from the web, said parts having respective flat external shoulders for engagement with the internal shoulders of the cavity, and said abutting faces being shaped to normally deflect said parts angularly outwardly about respective axes extending generally longitudinally of the seal towards said shoulders, while permitting the ear to be compressed for fitting into said cavity.

* * * * *